United States Patent [19]

Di Motta

[11] 4,400,955

[45] Aug. 30, 1983

[54] DUPLEX LOCK

[76] Inventor: Benito Di Motta, via Palestro, Cooperativa "Osiride", 84100 Salerno, Italy

[21] Appl. No.: 312,463

[22] Filed: Oct. 19, 1981

[30] Foreign Application Priority Data

Nov. 3, 1980 [IT] Italy ..... 64817 A/80

[51] Int. Cl.[3] ..... E05B 15/14; E05B 29/02; E05B 35/12

[52] U.S. Cl. ..... 70/339; 70/366; 70/377; 70/421

[58] Field of Search ..... 70/337, 339, 364 R, 70/364 A, 365, 366, 376, 377, 392, 419, 421

[56] References Cited

U.S. PATENT DOCUMENTS

| | | | |
|---|---|---|---|
| 2,970,466 | 2/1961 | Wellekens | 70/339 |
| 3,585,826 | 6/1971 | Mercurio | 70/366 |
| 3,605,463 | 9/1971 | Epstein | 70/364 A |
| 3,908,417 | 9/1975 | Beudat | 70/364 A |
| 4,114,410 | 9/1978 | Astier | 70/339 |
| 4,332,153 | 6/1982 | Miles | 70/339 |

*Primary Examiner*—Robert L. Wolfe
*Attorney, Agent, or Firm*—Pollock, Vande Sande & Priddy

[57] ABSTRACT

A duplex lock codable by a master key and releasable by a duplex key and comprising a first fixed hollow cylindrical body in which a second cylindrical body is rotatably mounted. An axially shiftable slider is firmly secured to the second cylindrical body for locking it relative to the first cylindrical body by insertion in a cavity provided at the bottom of the first cylindrical body. When the slider is withdrawn, the two cylindrical bodies are released. The slider is provided with a plurality of axially spaced recesses which by axial movement of the slider can be brought into alignment with a plurality of apertures in the rotatable cylindrical body. Each of the apertures accommodates a U-shaped rocker lever having a front U-shaped end facing the slider and a rear end attached to a helical spring tending to pull the rocker lever toward an abutment surface in the interior of the rotatable cylindrical body. When the master key is inserted in the rotatable cylindrical body, the legs formed by the U-shaped ends of the rocker levers are lifted and swung into the recesses in the slider and when the duplex key is inserted axially in the rotatable cylindrical body adjacent the master key, the legs of the rocker levers are lifted and swung by the same amount in the opposite direction, resulting in centering of the slider and permitting it to be withdrawn axially to open the lock.

6 Claims, 8 Drawing Figures

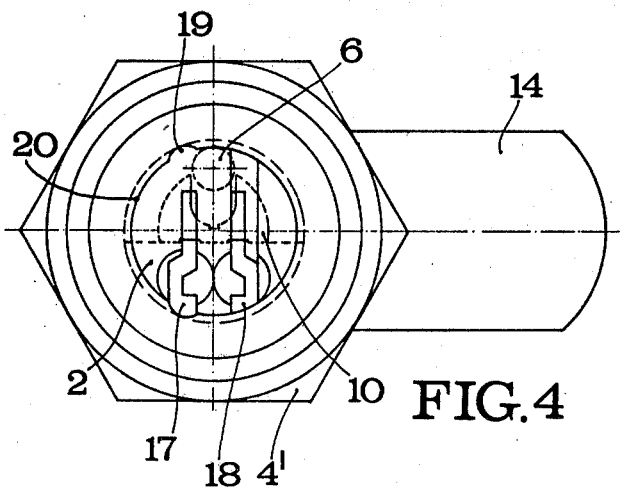
FIG. 4
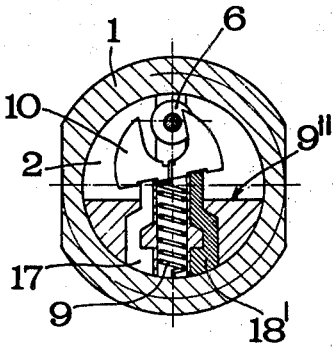
FIG. 5
FIG. 8
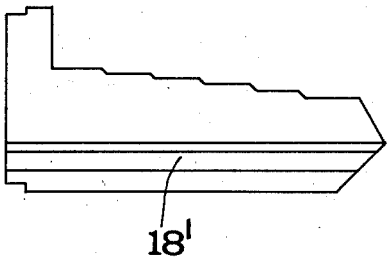
FIG. 6
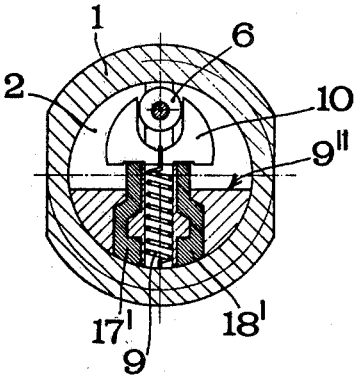
FIG. 7
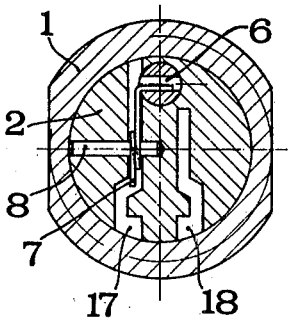

DUPLEX LOCK

BACKGROUND OF THE INVENTION

This invention relates to a duplex lock codable by a master key and releasable by a duplex key.

The problem of providing a safety lock has given rise to a great number of solutions working on various principles and all aiming at increasing security and efficiency of the lock. Also the Applicant of the present application has already made a prior invention on which U.S. Pat. No. 3,726,116 has been issued on Apr. 10, 1973 and which relates to a safety lock similar to the one to be described hereinafter, in which the locking elements are fixed in helical springs. The lock described in Applicant's aforementioned prior patent and other similar locks have the drawback that they have to be readjusted when the balanced operation of the moving parts is impaired by wear of cooperating members and use of the lock. Further, such readjustment must be precise and accurate.

It is an object of the present invention to overcome these drawbacks by providing a lock that does not require any such readjustment and affords a great variety and ease of coding together with a high degree of security of operation.

SUMMARY OF THE INVENTION

The invention provides a duplex lock which is codable by a master key and releasable by a duplex key and comprises a fixed hollow cylindrical body adapted to be secured to the movable element to be opened and closed by the lock and a second substantially cylindrical body rotatably mounted within the cavity of the fixed hollow cylindrical body. The locking element between the two cylindrical bodies is formed by an axially movable slider firmly secured to the movable body but adapted to be anchored by means of a spring in a recess at the bottom of the fixed body. The slider is provided with a plurality of restrictions of diameter of frustoconical shape tapering toward the point of locking. The movable body is provided with a plurality of recesses located adjacent the restrictions of diameter of the slider and each receiving a U-shaped rocker lever whose U-shaped portion is facing the slider. The rocker levers are resiliently retained along the center line of the bridge portion of the U of the U-shaped rocker levers by helical springs acting in the radial direction and tending to move the U-shaped rocker levers away from the slider. The helical means urge the U-shaped rocker levers with their rear portion against an abutment surface provided in the interior of the movable cylindrical body. The movable cylindrical body is provided with a pair of slots extending symmetrically relative to a plane normal to the abutment surface and adapted to receive a pair of coded keys, i.e. a master key forming the coding of the lock and normally retained therein and a duplex key of the same coding as the master key. The insertion of the master key in the lock in the locked position of the slider causes the legs of the U-shaped rocker levers engaging this key to be lifted and swung toward the recesses in the slider which is thus prevented from withdrawing from its locked position whereas the insertion of the duplex key causes the legs of the U-shaped rocker levers to be equally lifted and swung in the opposite direction relative to the slider, this second swinging movement causing the slider to be centered relative to the U-shaped rocker levers and permitting the slider to withdraw axially between the legs of the U-shaped rocker levers to release the two cylindrical bodies and thus open the lock.

BRIEF DESCRIPTION OF THE DRAWINGS

FIG. 4 is a front view of the lock;

FIG. 5 is a cross section through the lock in the position with the master key inserted therein;

FIG. 6 is a cross section through the lock in the position with both the master key and the duplex key inserted therein;

FIG. 7 is a cross section through the inner end portion of the lock, and

FIG. 8 is a side elevational view of a master key having the same profile as the duplex key shown in FIG. 3.

DETAILED DESCRIPTION OF PREFERRED EMBODIMENT

Figure 1:
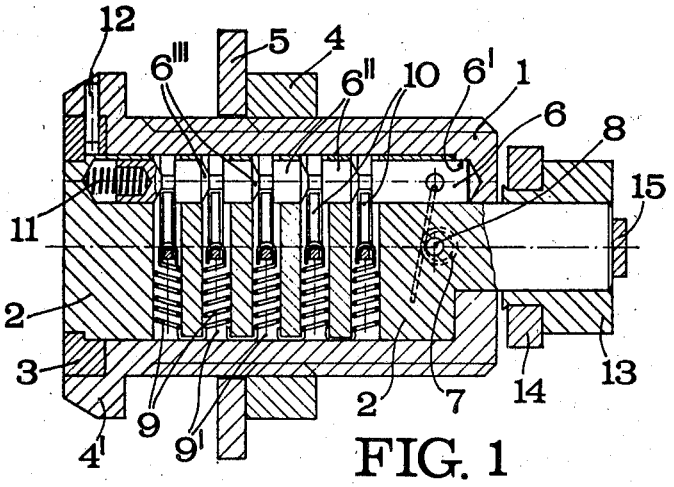
FIG. 1 is a longitudinal section through a duplex lock according to the invention, which is shown in the locked position.

Referring now to the drawings, particularly FIG. 1, a lock according to the invention substantially comprises a fixed hollow cylindrical body 1 adapted to be secured to a wall to be controlled, i.e. opened and closed, by the lock, and a movable substantially cylindrical body 2 received in an appropriately shaped cavity provided for this purpose in the hollow cylindrical body 1. As seen more clearly in FIG. 2, the fixed cylindrical body 1 is provided with means for securing it to the door to be controlled, such as a nut 4 and a washer 5, which can be screwed onto the threaded outer surface of the body 1. The door to be controlled, not shown, is secured between the washer 5 driven by the nut 4 and a projecting portion 4' extending perpendicularly of the axis of the body 1 from the front end portion thereof.

The movable body 2 is mounted axially in the cavity of the hollow fixed cylindrical body 1 by means of a ring nut 3 (FIG. 1) screwed in between the projecting portion 4' and the front portion of the movable body 2. The ring nut 3 is retained in position by a stop pin 12 located radially in the projecting portion 4'.

The movable body 2 has a plurality of axially spaced radial apertures 9', five in the illustrated embodiment, each receiving a U-shaped rocker lever 10 secured to a helical spring 9 on the side remote from the U-shaped open end of the rocker lever 10. The helical springs 9, which are anchored to the center of the U-shaped recess in the rocker levers 10, tend to pull the latter downwardly toward a plane abutment surface 9'' in the apertures 9'.

As shown in FIG. 1, a substantially cylindrical slider 6 is secured to the movable body 2 and extends parallel to the axis of the cylindrical bodies 1 and 2 through the open U-shaped portion of the rocker levers 10 and has a plurality of axially spaced radial recesses adjacent the rocker levers 10. The slider 6 is urged axially by a helical spring 11 into a recess 6' provided inwardly in the bottom wall of the fixed hollow cylindrical body 1.

Figure 3:
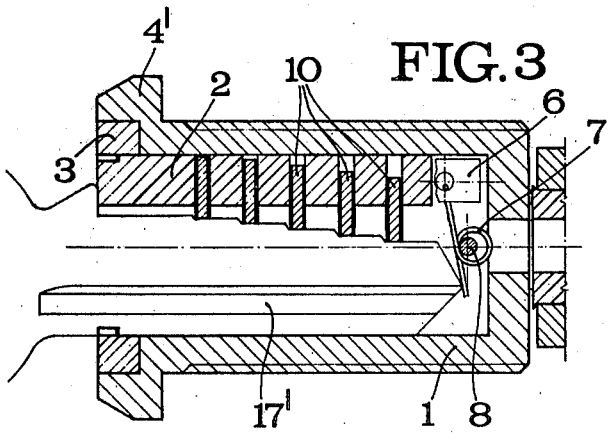
FIG. 3 is a longitudinal section through the lock with the duplex key inserted therein and the movable cylindrical member released.

When the front end of the slider 6 engages the recess 6', the movable body 2 is prevented from rotating relative to the fixed body 1. The radial recesses in the slider 6 form therein a plurality of axially spaced cylindrical elements 6'' each terminating with a frustoconical tapering portion 6''' directed toward the locking recess 6'. The inner end portion of the slider 6 located adjacent the locking recess 6' supports a flexible coupling spring 7 wound around a spring retainer pin 8 secured to the movable body 2. The free end of the flexible coupling spring 7 terminates adjacent the end of the duplex key when inserted in the lock as shown in FIG. 3. The anchoring of the flexible coupling spring 7 to the end of the slider 6 is best seen in FIG. 7.

Figure 2:
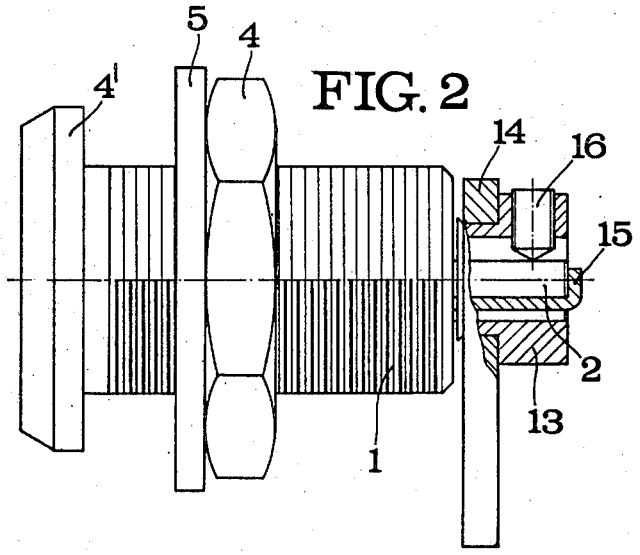
FIG. 2 is a side elevational view of the lock of FIG. 1.

As shown in FIG. 1, a closure plate 14 is secured outwardly to the movable body 2 at the end thereof remote from the projecting portion 4'. This end of the movable body 2 further carries a closure plate retaining sleeve 13, a shim plate 15 and a set pin 16 (FIG. 2).

The profile of the duplex key and that of the master key as they are introduced into the lock as seen in FIGS. 4 to 7, this profile being formed by keyholes 17 and 18, respectively. The duplex key and the master key themselves are indicated by 17' and 18', respectively. As shown in FIG. 4, a circular flaring portion 19 is formed on an edge 20 at the front end of the lock to facilitate introduction of the master key 18' into the lock. After the master key 18' has been introduced into the lock and rated through 180°, it will be stopped by the edge 20 at the front end of the lock. In this position it can only be released by introduction of the duplex key 17' which has the same profile as the master key 18'.

OPERATION OF THE LOCK

Assuming that the lock is in the locking position shown in FIG. 1, introduction of the master key 18' into the lock causes the rocker levers 10 to be unbalanced as shown in FIG. 5. In this position the rocker levers 10 are inclined toward the radial recesses in the slider 6 according to the coding of the master key and prevent the slider from withdrawing from the locking position shown in FIG. 1.

When the duplex key 17', which has the same coding as the master key 18', is introduced into the lock as shown in FIG. 6, the coding of the duplex key lifts opposed legs of the U-shaped rocker levers 10 to a position in which they are lifted over the horizontal to the same level as the legs of the U-shaped rocker levers first lifted by the master key 18'. In this position the slider 6 is free to withdraw from the locking position shown in FIG. 1 and, as it is pushed by the point of the duplex key 17' (FIG. 3), withdraws from the initial position under the combined action of the point of the duplex key 17' and the flexible coupling spring 7.

In this condition the movable body 2 is free to rotate in the cavity of the fixed cylindrical body 1 so that the closure plate 14 can be rotated and the door to which the lock is secured can be opened. On withdrawal of the duplex key 17' from the lock in the closed position, with the slider 6 positioned adjacent the apertures 9' in the movable body 2 with which it is to be coupled, the helical spring 11 urges the slider 6 toward the locking recess 6' as the slider is no longer retained by the flexible coupling spring 7. The radial recesses in the slider then move to a position in which they are aligned with the U-shaped rocker levers 10 so that the legs at the free ends of the U-shaped rocker levers 10 enter the radial recesses in the slider under the action of the coding of the master key 18' and thus prevent withdrawal of the slider 6.

CHANGE OF CODING

For changing the coding of the lock a new master key different from the previous one has to be inserted in the lock. After a duplex key similar to the master key inserted in the lock has been introduced and the movable cylinder 2 has thus been released, it is rotated through 180° until it assumes the position indicated in dash lines in FIG. 4. The master key is extracted through the opening 19. After the duplex key is extracted, the rocker levers 10 engage the plane horizontal abutment surface 9''.

After another master key with the desired coding has been introduced, the movable cylinder 2 is again rotated through 180° in the opposite direction until the slider 6 is aligned with the locking recess 6' at th bottom of the fixed hollow cylindrical body 1. In this position the helical spring 11 urges the slider 6 forward toward the locking recess 6', the axially spaced cylindrical elements 6'' on the slider 6 move over the legs of the U-shaped rocker levers 10 and the radial recesses on the slider 6 are positioned adjacent these legs so that the slider 6 is again locked and can only be released when a duplex key having the same coding as the new master key just introduced is inserted into the slot 17.

Although a preferred embodiment of the invention has thus been described in detail and illustrated in the accompanying drawings, it is to be understood that the invention is not limited to this precise embodiment and that numerous changes and modifications obvious to one skilled in the art may be made therein without departing from the scope of the invention as defined by the accompanying claims.

I claim:

1. In a duplex lock codable by a master key and releasable by a duplex key and having a first fixed hollow cylindrical body adapted to be secured to a movable element to be opened and closed and a second substantially cylindrical body rotatably mounted within a cylindrical cavity in said first hollow cylindrical body, the improvement comprising an axially movable slider for locking said movable cylindrical body to said fixed cylindrical body, said slider being secured to said movable body but adapted to be coupled under the action of spring means to said fixed body, said spring means causing said slider to be inserted in a locking recess in a bottom wall of said fixed body; said slider being provided with a plurality of axially spaced radial recesses of frustoconical shape tapering toward said locking recess; said movable body being provided with a plurality of axially spaced radial apertures adjacent said radial recesses in said slider; a U-shaped rocker lever in each of said radial apertures, each of said U-shaped rocker levers having a U-shaped forward open end facing said slider; spring means secured to a rear end of each of said U-shaped rocker levers along a center line of said U-shaped forward ends thereof to bias said U-shaped rocker levers away from said slider, said spring means tending to urge said U-shaped rocker lever with said rear ends thereof toward an abutment surface provided in the interior of said movable cylindrical body; a pair of radial keyholes in said movable cylindrical body for receiving each of said master and duplex keys, said keyholes extending symmetrically relative to a plane located perpendicularly of said abutment surface; said master key forming the coding of the lock and being normally retained therein and said duplex key having the same coding as said master key; insertion of said master key into the lock in the locked position of said slider causing said U-shaped forward open ends of said U-shaped rocker levers engaging said master key to be lifted and swung toward said radial recesses in said slider to prevent the latter from withdrawing from its locked position and insertion of said duplex key into the lock causing said U-shaped forward open ends of said U-shaped rocker levers to be lifted and swung to the same extent in the opposite direction relative to said slider, said latter swinging movement of said U-shaped rocker levers causing centering of said slider relative to said U-shaped rocker levers to permit said slider to withdraw axially through said U-shaped forward ends of said rocker levers to release said first and second cylindrical bodies and thus open the lock.

2. A duplex lock as claimed in claim 1, wherein a circular flaring portion is formed on an edge at a front end of the lock to facilitate introduction of said master key into and withdrawal from the lock when said movable body is released and rotated through 180° relative to its normal operating position.

3. A duplex lock as claimed in claim 1, wherein said pair of keyholes is arranged at a front end of said movable cylindrical body in a mirror image fashion relative to a vertical plane.

4. A duplex lock as claimed in claim 1, wherein, with said master key inserted therein, when said duplex key is inserted said U-shaped forward open ends of said U-shaped rocker levers are aligned and this alignment is maintained and said slider is centered relative to said U-shaped forward open ends of said rocker levers.

5. A duplex lock as claimed in claim 1, wherein a flexible coupling spring is secured to an inner end of said slider and a pointed inner end of said duplex key is arranged to act on said flexible coupling spring to facilitate withdrawal of said slider when it is released by said U-shaped forward open ends of said rocker levers in alignment.

6. A duplex key as claimed in claim 1, wherein codability of said lock is ensured by said master key when it is inserted in the lock, and when said master key is withdrawn from the lock said U-shaped rocker levers cooperate to bring said lock into a neutral position.

* * * * *